United States Patent [19]

Hong

[11] 4,266,326

[45] May 12, 1981

[54] WATCHBAND CONNECTOR

[76] Inventor: Lai F. Hong, Blk. E & G, 15/F., Kingsway Ind. Bldg., 173-175, Wo Yi Hop Rd., Kwai Chung, N.T., Hong Kong

[21] Appl. No.: 63,725

[22] Filed: Aug. 6, 1979

[51] Int. Cl.[3] ..... A44C 5/18

[52] U.S. Cl. ..... 24/265 WS; 24/230 BC; 224/177

[58] Field of Search ..... 24/265 WS, 265 R, 265 A, 24/230 BC, 73 WW; 248/221.3; 403/327, 328; 224/177, 164, 165, 166

[56] References Cited

U.S. PATENT DOCUMENTS

| | | | |
|---|---|---|---|
| 1,403,192 | 1/1922 | Pfaus et al. | 24/73 WW |
| 1,687,365 | 10/1928 | Dike | 24/265 WS |
| 2,075,304 | 3/1937 | Sand | 224/177 |
| 2,455,929 | 12/1948 | Hattan | 24/230 BC |
| 2,833,015 | 5/1958 | Kreisler | 24/230 BC |
| 3,676,903 | 7/1972 | Kian | 24/265 WS |
| 3,676,904 | 7/1972 | Shteinshleifer | 24/265 WS |
| 3,802,654 | 4/1974 | Jenko et al. | 248/221.3 |
| 3,964,652 | 6/1976 | Fuld | 24/265 WS |
| 3,979,801 | 9/1976 | Tareau | 24/230 BC |

FOREIGN PATENT DOCUMENTS

| | | | |
|---|---|---|---|
| 543963 | 7/1957 | Canada | 24/265 WS |
| 1480245 | 4/1967 | France | 24/230 BC |
| 304084 | 11/1949 | Switzerland | 24/265 R |

*Primary Examiner*—Victor N. Sakran

*Attorney, Agent, or Firm*—Balogh, Osann, Kramer, Dvorak, Genova & Traub

[57] ABSTRACT

A watch band is provided which includes a locking connector means and a watch case male lug. The male lug has flat parallel spaced raised surfaces, the female portion of the connector has two spaced top faces which overlie but are closer together than the raised surfaces of the lug and at least one side wall having a lowered segment between two raised segments providing a suitable configuration for passage of a locking member. The locking member has a neck portion for abuttment of the faces of the female member and shoulder portions, the edges of which abut the sidefaces of the raised surfaces of the male lug when the male lug and female portion of the connector are interengaged.

2 Claims, 4 Drawing Figures

FIG. 2
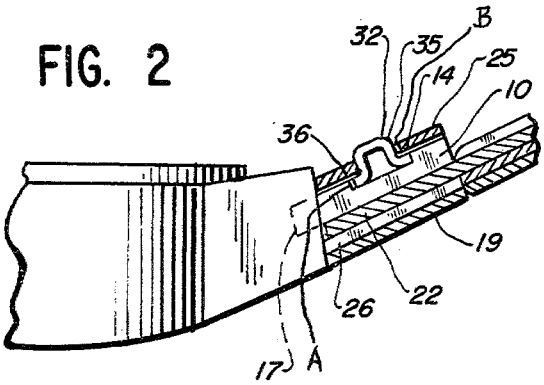
FIG. 4
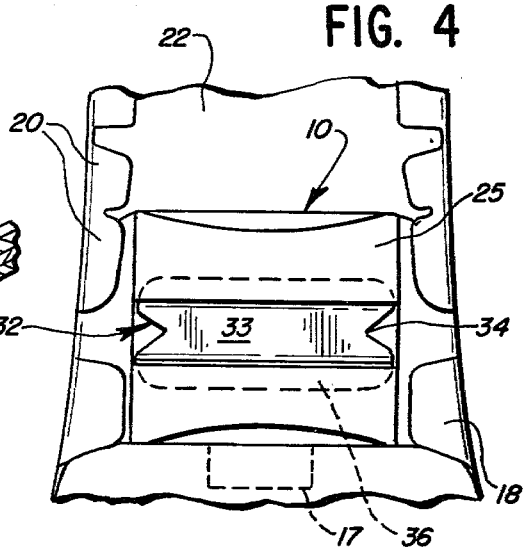
FIG. 3
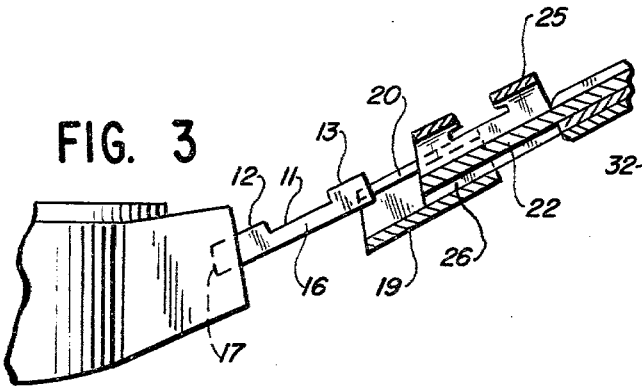
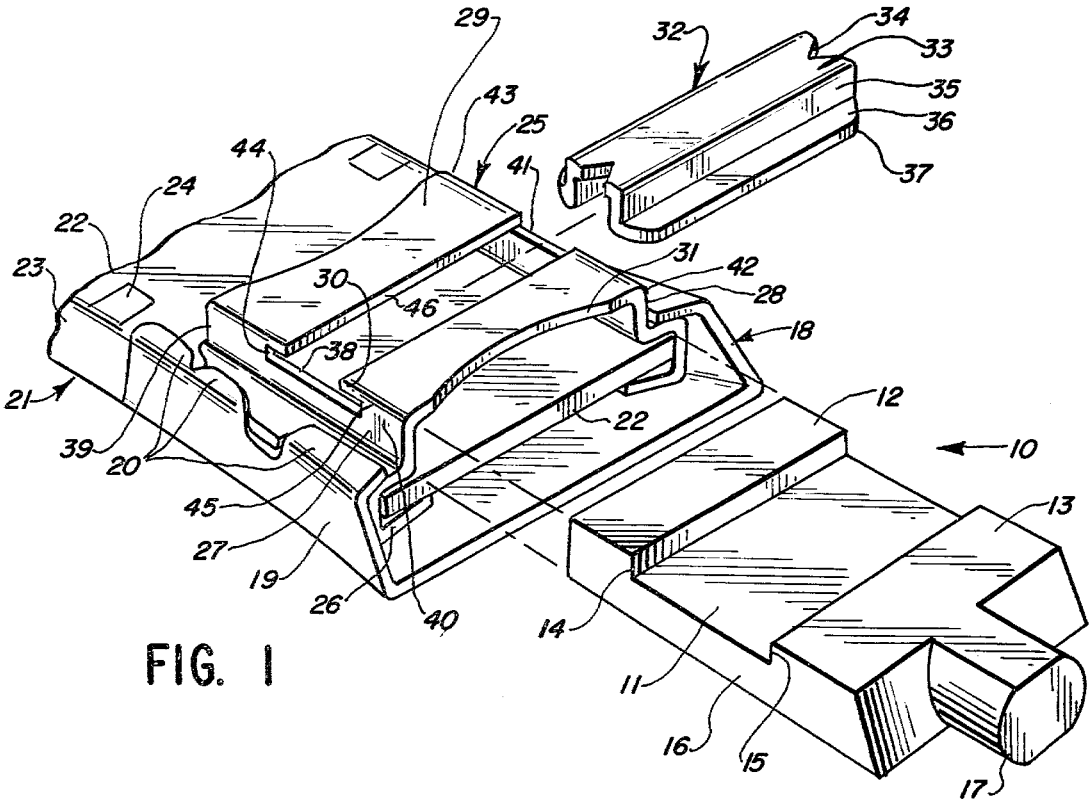
FIG. 1

WATCHBAND CONNECTOR

BACKGROUND OF THE INVENTION

The present invention relates to a watch band and connector therefor wherein the band may be easily removed from the watch casing.

Traditionally, watch bands have been secured to watch casings through spring-loaded pins connectable through outwardly projecting lugs on the casing. While this mechanism fulfills the purpose for which it is intended, professional removal is usually required and the pins are easily lost when the spring restraint is removed.

Recently, for esthetic reasons, watches have been designed in which the band and watch give the appearance of being unitary and, indeed the actual soldering of band to watch has been used to provide a unitary decorative entity. Difficulties inherent in this approach are apparent in that the separation of band and watch must be done by an expert and often the watch must be returned to the factory. Also defects in the band effectively preclude the use of the watch.

It would be desirable, therefore to provide means for connecting the band to the watch casing which would give the appearance of a unitary entity, but which could be removed easily and without special tools.

An attempt to provide such a combination is set forth in Fuld U.S. Pat. No. 3,964,652 in which the casing lug is provided with a T-shaped receiving notch, which engages a T-shaped locking member. The long leg of the T-shaped member extends beyond the receiving notch and the band has an end connector portion featuring side walls perpendicular to the band and a top portion perpendicular to the side walls. When assembled, the bottom of the end portion overlies the outer portion of the lug, i.e., the part facing the wearer, while the top portion overlies the locking member. The long leg of the locking member extends beyond the top portion of the connector and is bent backwards to overlie the outer face of the connector thereby maintaining a locked connection between the casing and the band.

While such a combination does provide for easy joining and removal of the band and casing and also provides a satisfactory appearance, it suffers from some serious disadvantages. First, the T-shaped part must, of necessity be extremely thin and therefore is likely to break upon bending, either to lock the band to the casing or to remove it. Repairers must, therefore, keep replacement elements. Secondly, outward strain on the locking leg produced by normal wrist movement would produce shear or bending forces acting against the leg which might cause the band to separate from the casing.

SUMMARY OF THE INVENTION

According to this invention a watch band and casing can be easily joined to produce a pleasing esthetic effect, the casing and the band can be readily separated without the likely destruction of the locking means and assembly and disassembly can be accomplished in one embodiment of the invention by means of any pointed, tapered tool.

This is accomplished by providing a watch case lug suitable for permanent attachment to the watch case. Preferrably one male configured lug would be connected to each end of the watch case. The watch case lug has two flat, spaced apart coplanar raised surfaces extending transversely to the direction of the watch band after attachment. The raised surfaces are separated by a lowered parallel surface and the inwardly directed sides to the raised surfaces are parallel to each other and perpendicular to the raised surfaces.

The watch band end has mounted thereon or as an endward extension thereof, a female locking member with two upper, spaced faces which, when engaged in a locking relationship with the male lug, overlie the spaced raised surfaces of the lug with the space between female upper faces being less than that between the raised surfaces of the male lug.

The female member also has two side walls each featuring two raised segments separated by a lowered segment, with the first side wall having a lowered segment lower and wider than the second side wall. The first side wall in combination with the upper surface forms an entry for insertion of a locking member.

The locking member has a flat top portion, a neck substantially perpendicular thereto forming parallel downwardly extending sides along the long axis and outwardly extending shoulders attached to each side of the neck. The long axis of the locking member is substantially equal to that of the long axis of the female member and the short axis of the top portion is substantially equal to the space between the faces of the top portion of the female member. The width of the locking member measured from the outer edges of the shoulders is substantially equal to the distance between the raised surfaces of the casing male lug. When the locking member is inserted through the opening formed by the first side wall and top faces of the female member and the female member is interengaged with respect to the male lug, the top portion of the locking member abuts the faces of the female member while the shoulders abut the inward faces of the spaced apart surfaces of the male lug; and the leading edge of the locking member abuts the inner portion of the second side wall of the female member.

The invention may be more readily understood by reference to the drawings in which:

FIG. 1 is a partially exploded perspective view of the components of the subject invention.

FIG. 2 is a side view partly in cross section of the watch band and with the locking mechanism in position; and FIG. 3 is a view similar to FIG. 2, but showing the watch case and band in a position before being interconnected.

FIG. 4 is a plan view of the watch band of the subject invention with locking member in place with the interengaged male lug and female member.

As can best be seen in FIG. 1, a watch band 21 having an inner portion 22 and an outer shell 23 attached thereto by bendable fastening tab 24 is provided. A mounting collar 18 is provided for attaching the female connecting member of the connector assembly to the band. The collar desirably has a decorative bottom surface identical or complementary to the band outer shell 23 and the outer shell 23 is truncated to allow for the attachment of the collar directly to the inner portion of the band 22. The side walls 19 of the collar 18 surround the sides U-shaped channels 26 of female member 25, with the U-shaped channel 26 tightly receiving the inner portion of the band 22. Bendable tabs 20 of the collar 18 help hold the female member in place and enable the outer face of the collar to provide suitable decorative effects in conjunction with the remainder of the band.

The unitary male lug 10 connected to the casing of the watch by post 17 has a side 16 with a U-shaped side profile, tow spaced, parallel flat raised surfaces 12 and 13 separated by a lowered surface 11, and flat side edges perpendicular to the raised surfaces and facing each other, one of which is illustrated at 14.

The connection is made by inserting the male lug 10 into the area between the top of the inner portion of the watch band 22 and the bottom of the upper faces 29 of the female member 25.

The female member 25 in addition has a semi-circular cutout area 31 at the top face which allows access to the back of the watch case W, a first side wall 27 with raised segments 39 and 40 and an extended lower segment 38 separating the raised segments. Opposite and parallel to side wall 27 is side wall 28 also having a lower segment indicated at 41 and two raised segments, 42 and 43. The lower segment 41 of the side wall 28 is both shorter and higher than the lower segment 38 of notched side wall 27; the notches of side wall 27 being formed by lips 30 of upper faces 29 and the extension of the lower segment 38. The purpose for the particular configuration of the female member and the male lug will become apparent from the remainder of the description.

The locking member 32 which performs the locking function has a top portion 33, a neck 35 extending downwardly on either side of the top portion with each side of the neck substantially perpendicular to the top portion and parallel to each other. Flaring outwardly essentially perpendicularly from each neck side are shoulder portions 36 having transverse edges 37. A V-notch 34 is provided on the top portion 33 for ease of insertion and removal of the male member 32 into the shaped opening formed by lips 30 and the extended lower wall 38 of side wall 27.

The relative positions of the various components when the watch band is connected to the case can best be understood by reference to FIG. 2.

For lockable engagement, locking member 32 is inserted so that shoulders 36 slide along notches 44 and 45 until the trailing edge of male member 32 is aligned with side wall 27. As best shown in FIG. 2, after insertion is complete, the edges 37 of shoulders 36 abut the inner faces 14 of lug 10 and the neck portion 35 abuts the side edges 46 of the upper faces of the female member 25. As can be seen by FIG. 2, once the male member 32 is in place, separation of the band from the watch casing without removal of the male member or destruction of the pieces is impossible.

Spacing A between shoulder portion 36 and lug 10 and spacing B between neck 35 and member 25 will enable the locking member 32 to exert forces in opposite directions, thus acting as a spring which will maintain the male lug 10 and female member 25 securely in position.

FIG. 3 of the drawings illustrates the watch case and band in a position just prior to interconnection or interfitting of the members.

FIG. 4 is a plan view taken from the inner side of the watch band and illustrates the assembled band and case with the locking male member 33 in position.

Furthermore, since the components used in the present invention may be of a heavier gage when compared to the prior art and do not have to be bent, they resist breakage and, by the nature of their configuration, resist accidental dislodgement.

Yet, in the currently preferred embodiment, removal of the male member is accomplished by means of any suitable tapered tool inserted in the V-notch provided.

As is apparent, several alternatives may suggest themselves to those with skill in the art which are within the scope of the appended claims such as alternative mounting means for the female member, but these are all designed to be within the parameters of the disclosure and claims of this invention.

What is claimed is:

1. An arrangement for connecting a wrist watch case to a watch band, comprising:

at least one male lug member projecting outwardly from the watch case, a female connector assembly disposed on at least one end of the watch band, and a locking member for preventing disengagement of said male lug member and said female connector assembly, said male lug member comprising a transversely disposed slotted portion of configuration as to accommodate said locking member, said female connector assembly comprising at least one side wall provided with an opening portion of such configuration as to enable access of said locking member through the side wall to said slotted portion of said male lug member, said male lug member comprising two coplanar raised flat, spaced-apart surfaces extending transversely to the long axis of the watch band and a parallel lowered flat surface disposed between said raised flat surfaces, said female connector assembly side wall comprising two parallel raised sections and a lowered section disposed between said raised sections, said female connector assembly further comprising a first and a coplanar second flat upper face spaced apart from each other, with each of said faces bridging one of said raised sections of said side wall, with the edge of each of the faces forming lips which extend over the lowered section of said side wall, and with each of said flat upper faces overlying one of said raised surfaces of said male lug member when said male lug member is engaged within said female connector assembly, with the space between said upper face being less than that between the male lug member surfaces, said locking member comprising an elongated planar top portion of substantially the same length as the bridging axis of the connector assembly, a first and second neck portion parallel to each other and substantially perpendicular to and below said top portion, a first and a second shoulder portion being attached to said first and second neck portions, respectively, and extending substantially perpendicularly outwardly therefrom, one edge of said male lug member abutting against said side wall of said female connector assembly after insertion through said opening formed by said first side wall and said lips of said female portion and the outwardly directed edges of said shoulders abutting the inward edges of said two raised surfaces of said male lug member.

2. The arrangement as claimed in claim 1, wherein said locking member has at least one notch located on its top portion.

* * * * *